United States Patent [19]

Kankaanpää

[11] 4,406,739

[45] Sep. 27, 1983

[54] GUIDE ROLL AND SUCTION BOX FOR TWIN-WIRE FORMING SYSTEM

[75] Inventor: Matti Kankaanpää, Espoo, Finland

[73] Assignee: Valmet Oy, Finland

[21] Appl. No.: 320,962

[22] PCT Filed: Mar. 13, 1981

[86] PCT No.: PCT/FI81/00018

§ 371 Date: Nov. 3, 1981

§ 102(e) Date: Nov. 3, 1981

[87] PCT Pub. No.: WO81/02753

PCT Pub. Date: Oct. 1, 1981

[30] Foreign Application Priority Data

Mar. 14, 1980 [FI] Finland ..... 800808

[51] Int. Cl.[3] ..... D21F 1/00; D21F 1/40; D21F 1/50; D21F 11/02

[52] U.S. Cl. ..... 162/203; 162/300; 162/301; 162/306; 162/363; 162/374

[58] Field of Search ..... 162/123, 203, 300, 301, 162/312, 314, 363, 374, 306

[56] References Cited

U.S. PATENT DOCUMENTS 3,649,449 3/1972 Nykopp ..... 162/374 X
3,726,758 4/1973 Parker et al. ..... 162/123 X
3,846,233 11/1974 Kankaanpää162 ..... 312/
3,992,253 11/1976 Schiel ..... 162/301 X
4,113,556 9/1978 Kankaanpää162 ..... 301 X/
4,172,759 10/1979 Kankaanpää162 ..... 306 X/

*Primary Examiner*—Richard V. Fisher
*Attorney, Agent, or Firm*—Steinberg & Raskin

[57] ABSTRACT

A procedure for dewatering and detaching a paper web from the second former wire. The composite of first and second wire and interposed web is contacted with a first cover part of a special suction box. A roll guiding the second wire, pressing from the side of the latter deflects its run. This pressure plus centrifugal force, and the differential pressure arising from the suction box, dewater the web. The second wire is separated to follow along with the guide roll, while web and first wire are acted on by the suction box vacuum. The first wire is then contacted with a second cover part of the suction box. A twin-wire former is also disclosed, featuring within its carrying wire loop, on its twin-wire run, a rotating forming roll deflecting the composite of wires and web as it laps a given sector of said forming roll. A special suction box at the ultimate end of the wires has a bipartite cover its parts angulated against each other and preferably planar.

14 Claims, 10 Drawing Figures

FIG. 7
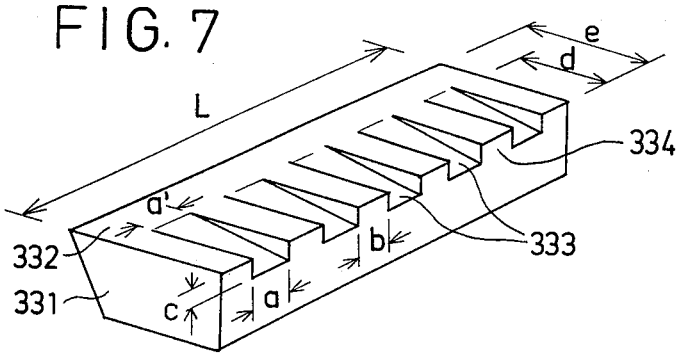
FIG. 8
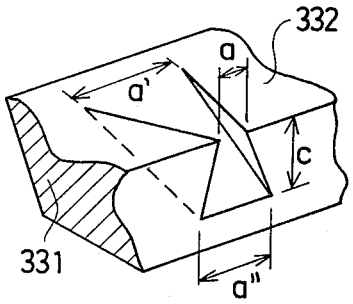
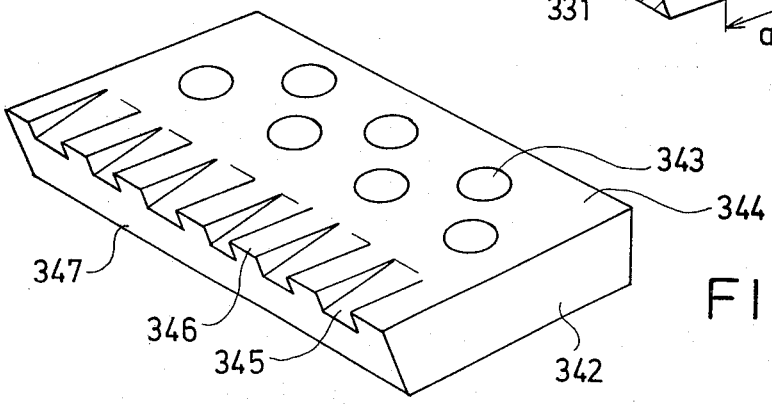
FIG. 9
FIG. 6
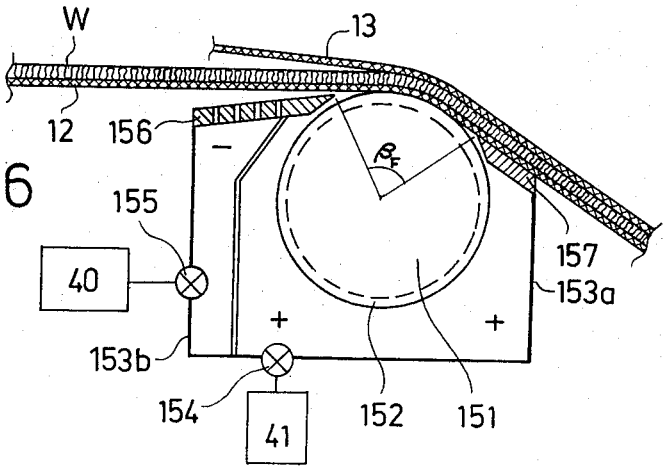

GUIDE ROLL AND SUCTION BOX FOR TWIN-WIRE FORMING SYSTEM

The present invention concerns a procedure in the wire section of a paper machine, wherein the web formation at least partially takes place between two wires, for dewatering the web and for detaching the web from one of the two wires.

The present invention moreover concerns a twin-wire former comprising a loop of the carrying wire, in the initial part of the run of which the web is formed with dewatering taking place in one direction therethrough, and a loop of a covering wire, which is at a suitable web forming stage conducted to cover the web and the carrying wire loop, in such manner that dewatering of the web is achieved through the covering wire loop as well, and in support of which after the twin-wire section the web is transferred for further conduction to the press section of the paper machine.

The present invention concerns twin-wire formers which are generally of the type disclosed in applicant's Finnish Pat. No. 50648, which corresponds to U.S. Pat. No. 3,846,233. Such former comprises a lower wire loop, the web being in actual fact formed on the substantially horizontal run or on a run thereof deviating from horizontal to some degree, after the headbox, with dewatering taking place in one direction downwardly through this wire, and an upper wire loop, which at a given web forming stage is conducted to cover the lower wire loop and the wet web being supported by the lower wire loop, in such manner that the dewatering takes place also through the upper wire. In this former the web being produced rests on termination of the forming and dewatering process supported on the lower wire, from which the web is thereafter detached for further conduction to the press section of the paper machine.

In a modification of the known former, the upper wire loop, i.e. the covering wire, also operates as a web forming wire, but that modification is concerned with the production of a two-ply or multi-ply web. The present invention may in certain substantial parts be applied in such formers as well in which a two-ply or multi-ply web is produced.

In said Finnish Pat. No. 50648 corresponding to U.S. Pat. No. 3,846,233, a special stationary forming shoe is used after a single-wire forming part, this forming shoe being provided with a suction zone and/or a blowing zone, but in the use of the stationary forming shoe a problem has been encountered that as it is operating against the carrying wire it often causes excessive attrition of the wire. Similarly, the surface of the forming shoe facing the wire is subject to wear at the same time. A problem additional to the wear problem just mentioned is the fact that the friction arising from the stationary shoe gives rise to extra energy consumption. In the said Finnish Patent has been disclosed, as an alternative, the use of a rotating dewatering roll, but this affords only a partial solution to the problems.

Regardless of whether formers of the described above are used to produce a single-ply or two-ply web, a problem frequently encountered is that after the dewatering stage between two wires the web fails to follow reliably along with the lower, carrying wire, but tends instead, from time to time at least, to follow along with the upper, covering wire. This may result in a web break and shutdown of the machine. In addition, even if no actual break should occur, the web may partially adhere to the upper wire, which may have the consequence for instance of poor upper surface finish of a single-ply web or of a splitting tendency of the web in the case where a two-ply web is being produced.

The object of the twin-wire former of the invention, considered as a whole, is to provide a construction which causes only a minimum of wire attrition and which reduces the drive energy consumption of the wire section, while at the same time the consumption of suction energy required for the actual dewatering is reduced. In general, structural components causing wear of the wire are naturally all those stationary members which guide the run of the wire and exert an influence on the dewatering of the web. In the present invention, the major part of dewatering takes place in a manner known in itself in the art on the first, single-wire part of the wire section, where stationary so-called foils are used. Considering the large water quantity escaping in the initial part of the wire section, which substantially reduces the friction of the wire against the dewatering members, the foils have rather minor significance as members causing wear of the wire and their use is to be recommended. Naturally, the foils may in some instances, as need arises, be totally or partially replaced with rotating dewatering structural components, such as table rolls or equivalent.

In order to achieve the aims stated above and others which will become apparent later on, the procedure of the invention is mainly characterized in that the procedure comprises the following steps:

conduction of a sandwich structure constituted by the first wire, the web fibre web and the second wire to the dewatering and detaching area, and conducting the first wire over the first cover part of a special suction box;

producing a directional change in the run of said sandwich structure with the aid of a guide roll of the second wire, which presses on the sandwich structure from the side of the second wire;

causing a web dewatering effect mainly in region of said directional change or adjacent thereto, partly by the aid of the pressure of said wires directed against the web and of centrifugal force, and partly with the aid of the differential pressure created by the special suction box;

separating the second wire from said sandwich structure and causing the second wire to follow along with said guide roll, and simultaneous subjecting of the web, together with the first wire, to the action of the subatmospheric pressure prevailing in said special suction box; and contacting the first wire with the second cover part of said special suction box.

In a favorable embodiment of the invention a rotating forming roll is used, which replaces the stationary dewatering shoe employed e.g. in the Finnish Pat. No. 50648 corresponding to U.S. Pat. No. 3,846,233 and which has a positive effect on the total energy consumption of the structure according to the present invention and in that connection, the wire attrition is reduced. One avoids with the aid of the above-mentioned forming roll the drawbacks introduced by the stationary forming shoes of the prior art; above all one achieves a reduction of the wire attrition and energy losses. These objects are obtained, as taught by the present invention, in a manner enabling the advantages sought in the Finnish Pat. No. 50648 corresponding to U.S. Pat. No. 3,846,233 to be achieved at the same time. Of these advantages may be mentioned, above all, efficient dewatering and good retention of fillers and other fines, and their uniform distribution across the web thickness.

The web formation may in principle take place, according to the present invention, in the same way as in the Finnish Patent mentioned above, that is, so that the first dewatering step takes place on a single-wire run, whereafter the direction of dewatering is inverted on the twin-wire section. However, one substantial difference in the respective variant of the invention is the replacement of the forming shoe with a rotating forming roll. This forming roll may, in equivalence with the Finnish Pat. No. 50648, have a foraminous surface and be provided with a suction or blow box. In some instances, a grooved surface design may be contemplated, as will be presented later on. It has been found, however, that a smooth surface roll is usable in most instances. It should moreover be taken into account that such a simple roll is remarkably lower in price than a foraminous surface roll. The radius of this forming roll usually cannot be as large as the radius of curvature of a stationary shoe, with the consequence the that distance which the web travels in the region of this dewatering element in contact therewith is reduced. Likewise, the dewatering capacity may be reduced, of course depending on the types of pulp stock used.

In the present invention, compensation for the reduced dewatering capacity should be provided by means of dewatering elements following after the forming roll in a manner, however, so that these dewatering elements will not cause any excessive wire attrition effect. If, expressly, the amount of upwardly directed dewatering turns out to be inadequate, owing to the brief wire contact of the forming roll, it is possible in the present invention, with a view to enhancing the dewatering, to use a grooved surface roll e.g. equivalent to that shown in the Finnish patent application No. 772129 corresponding to U.S. Pat. No. 4,172,759, but which roll is provided with a pressure chamber encircling it on that part of which has no wire contact, with the overpressure present in the chamber being allowed to communicate through the grooves in the roll surface to influence the dewatering on that sector which is lapped by the wire.

When the invention is being applied, a smooth surface roll is one of the most economical embodiments for the forming roll. The potentially lowered dewatering capacity incurred in using such a design must thus be made up for by other expedients.

With respect to the object of the invention of providing a means and an arrangement by the aid of which the above-presented drawbacks impairing the reliability in operation of the former and affecting the quality of the web that is manufactured, the invention relates to a special detaching suction box construction and to an upper wire guide roll substantially cooperating therewith. The said detaching suction box has as one of its important tasks to accomplish dewatering of the web, this being achieved in part due to suction and to the suction box cover design, and in part by utilizing the directional change taking place expressly in the run of the lower wire and the inertial, or centrifugal, force resulting therefrom. This change of direction of the wire is achieved by the combined effect of the suction box cover design and of the upper wire guide roll adjacent thereto. The detaching suction box mentioned in the invention constitutes the sole element causing any significant wire attrition, and this attrition can be fairly well minimized.

Another important function imposed on the detaching suction box under discussion is to detach the formed web, reliably and positively, from the upper wire and to transfer it to be supported by the lower wire for further conduction to the press section.

In a favorable embodiment of the invention, the detaching suction box has been disposed within the lower wire loop, and it operates expressly in cooperation with the upper wire guide roll. The detaching suction box is equivalent in its basic design and mode of operation to conventional so-called flat suction boxes used on a Fourdrinier wire section. A substantial difference from these flat suction boxes of the prior art is that the cover of the suction box used in the invention is composed of two substantially planar parts which are disposed at an angle to each other and between which runs a free gap extending across the machine breadth.

The suction box used in the invention is preferably so placed with respect to the upper wire guide roll that the free gap between the cover parts substantially corresponds to a given sector of the upper wire guide roll in a manner which will be described below. In principle, the central angle of the cross section corresponding to this sector is substantially equal to the angle between the planar parts of the detaching suction box cover. The said cover parts may comprise, for instance, ceramic material with a low coefficient of friction or of plastic and they may be similar in construction to those conventionally used on the flat suction boxes of Fourdrinier wire sections. The cover parts may both be provided with piercing apertures, which may be round, elongated, or in the form of slits extending over the entire breadth of the cover transversely to the direction of travel of the wire. In certain instances, the first cover part may be a solid strip. The detaching suction box is in a conventional manner, mostly through the end portion, connected to the vacuum system of the paper machine.

In the following, the invention is described in detail with reference being made to certain examples of the invention, presented in the figures of the attached drawing, to the details of which the invention is not confined.

FIG. 1 presents, in elevational view, a twin-wire former according to the invention.

FIG. 2 presents, in schematic partial view, a modification of the twin-wire former of FIG. 1, at the detaching suction box.

FIGS. 3A and 3B present alternative modifications of the detaching suction box of the invention, differing in their body and cover parts.

FIG. 4 presents the cover geometry of an advantageous embodiment of suction box design.

FIG. 6 shows the forming roll, provided with an external overpressure chamber.

FIG. 7 shows a grooved modification of the first cover part of the detaching suction box.

FIG. 8 shows an advantageous embodiment of one groove in the first cover part illustrated in FIG. 7.

FIG. 9 shows a possible design of the second cover part of the detaching suction box.

Although in the following the invention is described, referring to FIG. 1 in regard to a web former primarily applicable in manufacturing printing papers, it is emphasized that the invention is also appropriate for use in multi-ply web formers with a similar basic structure.

Figure 1:
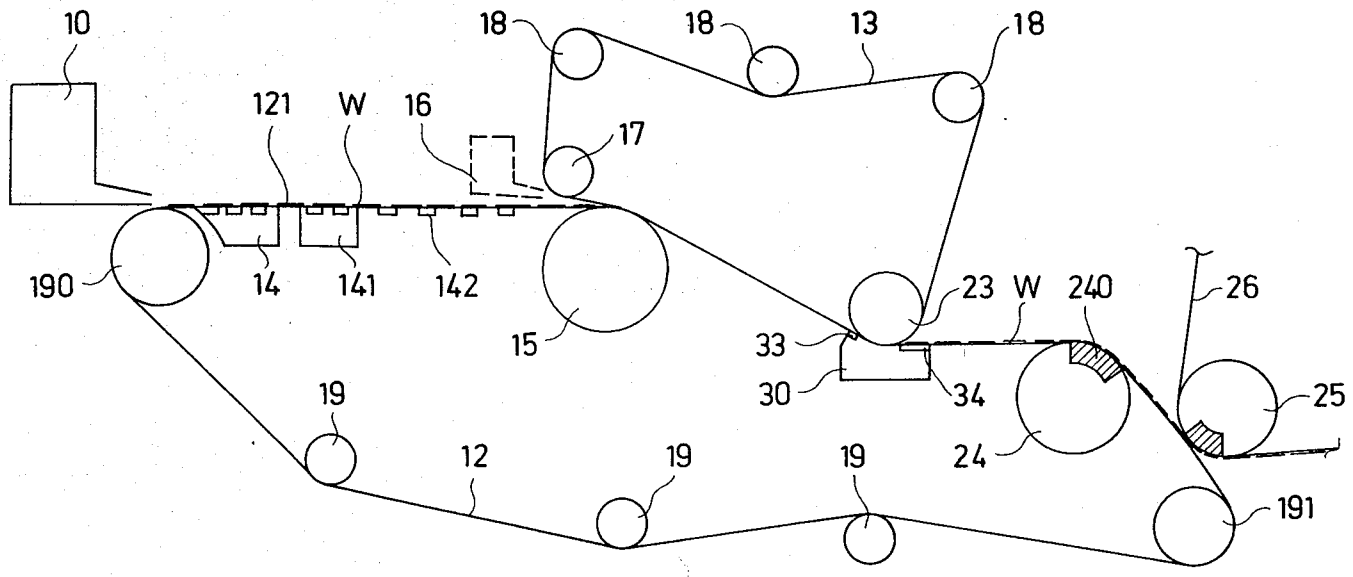

The web former depicted in FIG. 1 comprises two wires, namely, the lower wire 12 and the upper wire 13, wherein the lower wire 12 serves as a carrying wire for the web W and the upper wire 13 serves as a wire covering the web. The lower wire 12 constitutes after the headbox 10, a single-wire planar wire section 121, in connection with which are provided a suitable number of dewatering elements known in themselves in the art, such as a forming board 14, a wet suction box 141, and foils 142. The guide rolls 17 and 18 guide the run of the upper wire 13 to conjoin with that of the lower wire 12. In FIG. 1 a headbox 16 is illustrated by dash lines, which may supply pulp stock e.g. at the roll 17 into the interspace of wires 12 and 13 for the forming of a surface layer upon the web W which has already been formed. In the region of the joined run of wires 12 and 13 there is, to begin with, a fairly large diameter forming roll 15, which may be a smooth roll, a grooved roll or a perforated roll. Within the lower wire loop have furthermore been placed a plurality of wire guide rolls 19, a breast roll 190 and a return roll 191.

Adjacent to the upper wire guide roll 23, within the loop of the lower wire 12, there is a special detaching suction box 30, by the aid of which is, among other things, ensured that the web W formed on the wire 12 will be detached from the upper wire 13 and will conducted, supported by the lower wire 12, further to the suction roll 24, whereafter the web W is transferred with the aid of a pick-up roll 25 onto the felt 26, which carries the web W forward to the press section. The suction zone of the suction roll is indicated by the reference numeral 240. The conventional drain chutes and save-alls, which are commonly employed on wire sections, being component forming no part of the invention, have been omitted.

The forming roll 15 mentioned above is advantageously one with a smooth and solid shell, but it may also have a foraminous surface and be provided with an internal suction zone. In some cases a recessed surface forming roll may be used which has been provided with an external suction box, as has been shown in FIG. 6, to which reference will be made hereinbelow. One recessed surface roll of this kind has been disclosed in the applicant's U.S. Pat. No. 4,172,759.

The roll 15 has a rather large diameter. The diameter of the roll is, for instance, between 1000 and 1500 mm, depending on the working breadth of the wire section. It is one substantial feature of the invention that a rotating forming roll 15 is used, and that subsequent to this roll within the carrying wire 12 has been disposed a special detaching suction box 30. Most essential in this suction box 30, from the viewpoint of the invention, is the circumstance that as a whole it may be considered to have a concave surface and that it acts in cooperation with the wire guide roll 23, which has been placed at a corresponding location within the loop of the covering wire 13.

Figure 4:
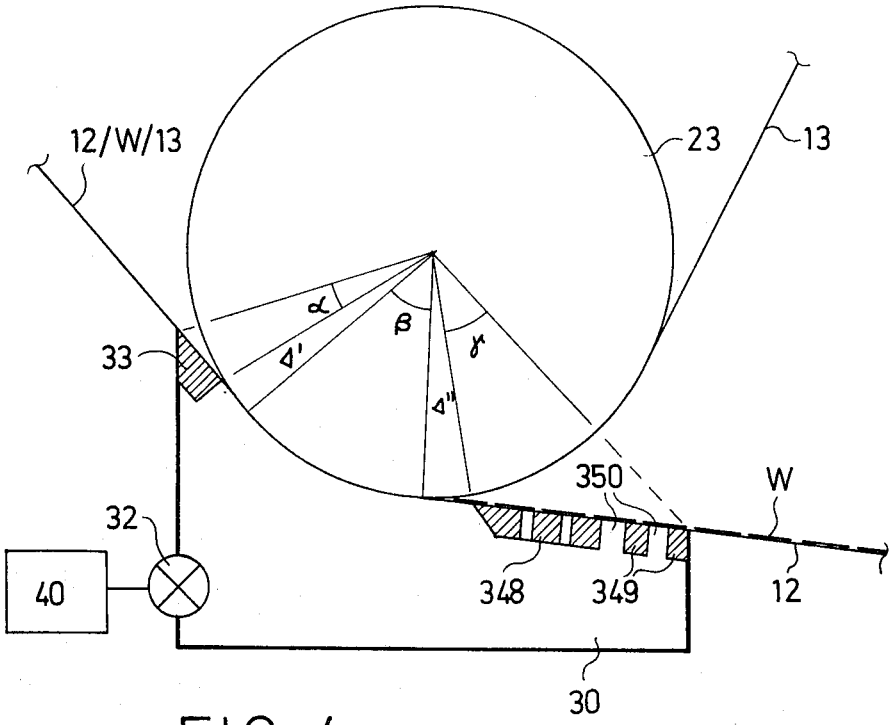

In FIG. 1, the run of the wire 12 after the detaching suction box 30 has been shown as being substantially horizontal, since the cover of athe suction box 30 is at the level of the top point of the suction roll 24. The run of the wire after the suction box 30 may also be clearly ascending, as depicted in FIG. 2, or descending as shown in FIG. 4, which figures shall be described in greater detail below.

Figure 2:
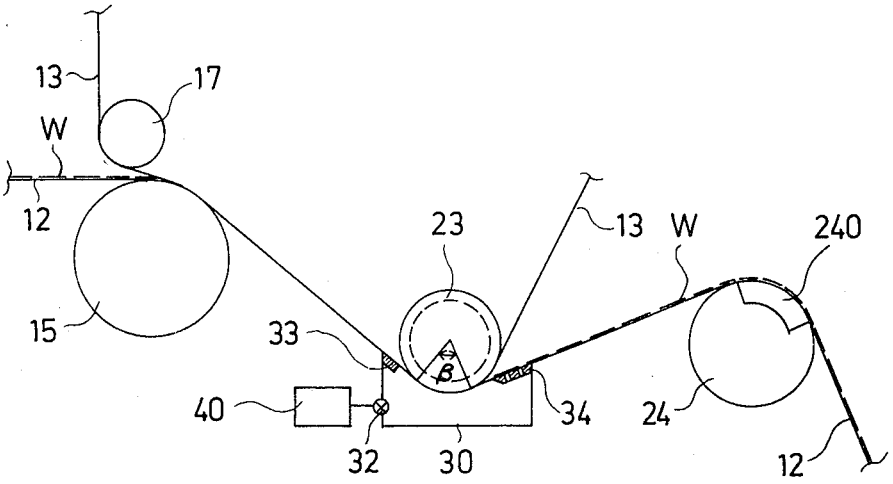

In FIG. 2, the guide roll 23 has been shown as placed between the forming roll 15 and the suction roll 24 so that the center of the roll 23 is substantially at the same level as the center of the suction roll 24. The consequence of this construction is that the run of the wire 12 after the detaching suction box 30 is clearly ascending and, consistent herewith, the directional change achieved with the aid of suction box 30 and roll 23 in the run of the wire 12 has a remarkable magnitude, for example about 60 degrees. In all different structural alternatives of the invention, this direction change of the wire 12 equals that central angle $\beta$ of the roll 23 which is defined by the points at which the lower wire 12 is tangent to the guide roll 23.

The height of the detaching suction box 30 and of the guide roll 23 of the upper wire 13 can be changed in greater or smaller amount as required, and this obviously affects the directional change of the lower wire 12 even quite remarkably. The observation can be made by comparing FIGS. 1 and 2 that in actual fact by a comparatively minor change in height of the suction box 30 the directional change of the lower wire 12 can be influenced to a great extent, and thereby the length of that sector in the region of which the upper and lower wires travel together, exerting strong pressure on the wet web W interposed between them, can be similarly varied. Increase of the said sector implies a longer time available for dewatering and, correspondingly, enhanced dewatering.

In FIG. 2 has also been shown the principle design, in cross section, of the detaching suction box 30. The ends of detaching suction box 30 are naturally solid. The design of the detaching suction box 30 may vary regarding its internal and body structures on one hand and the cover design on the other. Certain structural variants have been additionally depicted in FIGS. 3A,3B and 4. The frame structure of the suction box 30 is equivalent to the frame of a conventional wire section flat suction box and it may have a cross sectional shape e.g. of a quadrangle or of a letter U or V. The connecting of the suction box 30 to the vacuum system 40 of the paper machine and the fittings, connectors, control valves and water traps therein employed are known in themselves in the art and they are represented by a collective symbol 32. They have in themselves no bearing on the understanding and application of this invention.

Figure 5:
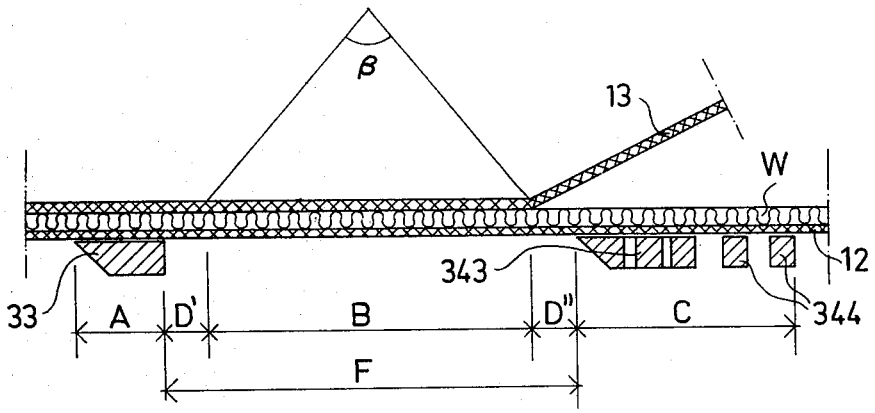
FIG. 5 illustrates the cover of the suction box of FIG. 4, developed into a plane, and the forming wires in adjacent relation, and the fibre web thereinbetween.

The cover design of the detaching suction box 30 is peculiar and different from conventional Fourdrinier wire section suction boxes in the respect that the cover comprises two parts 33 and 34 inclined with respect to each other, which are most commonly planar and which are separated by a relatively wide free gap F, which is illustrated in developed form in FIG. 5. This free gap communicates directly with the interior space of the suction box 30 and allows the suction in the suction box 30 to act on the web in this region.

This free gap is free only upwardly towards the wire 12 covering the suction box. The ends of the suction box 30 are naturally closed over the whole cover structure, and especially at the said free gap. Seals (not depicted) have been provided on the ends of the suction box 30 which act against the wire 12. In the area of the said free gap the directional change of the wires 13 and 12 takes place so that no friction causing wear of the wire occurs because the said directional change is accomplished with the aid of the roll 23 and there is then no absolute need to use any stationary members.

The free gap F separating the cover parts 33 and 34 of the suction box 30 is in normal operation of the wire section covered on its substantial part by the upper and lower wires 12,13 and by the interposed fibre web W, the sandwich structure 12/W/13 being urged by the upper wire guide roll 23 against the cover structure of the suction box 30.

The significance of said free gap as, in effect, a part of the suction box of the invention has to be stressed. In this regard reference is made to the general considerations mentioned above which relate to the operation of the suction box 30 of the invention as a structural component of twin-wire formers, and to the embodiments of the cover structure of the suction box 30 of the invention to be described below.

As shown in FIG. 2, there is on either side of the sector $\beta$ in the run of the wires 12 and 13 a comparatively open zone between the cover parts 33 and 34 and the sector $\beta$. At these zones, which extend over the entire breadth of the machine, "leakage air" is admitted into the suction box 30 in some amount through the sandwich structure 12/W/13. The detailed geometry of the zones is illustrated in FIGS. 4 and 5, where they have been denoted D' and D'' in FIG. 5, corresponding to the central angles $\Delta'$ and $\Delta''$ in FIG. 4.

The first leakage air zone D' is formed in the throat between the upper wire 13 and the roll 23, where owing to the rotation of the roll 23 an overpressure is created, which partly discharges through the zone D', contributing to promotion of the dewatering of the web and to the web's attachment to the lower wire 12. This leakage air zone also causes the pressing of the web W on the sector $\beta$ between the wires 12 and 13 to begin gently, without destroying the structure of the web W.

A leakage air zone which is useful regarding the operation of the suction box of the present invention may also be created with the aid of the special cover strip design shown in FIG. 7. It is also possible in certain cases that a perforation, mentioned below, of the first cover part can be used in lieu of the leakage air zone.

The second leakage air zone D'' is formed on the trailing side of the roll 23, where the leakage air flow through the web W on the lower wire 12 and into the suction box 30 has an important significance in the attachment of the web to the lower wire 12.

In the circumstances which prevailed on the applicant's experimetal paper machine on which the extension of the sector $\beta$ was 29 degrees and the corresponding peripheral lengths of the surface roll 23 (diameter of roll 23 being 800 mm) was about 200 mm, the appropriate leakage air zone width, which was adjustable, was found to be D',D''=30 to 80 mm. A favorable starting value for the designing and practical application of the apparatus of the invention within the apparatus geometry presented in FIG. 4 can be considered D'=D''=50 mm. The structure must naturally be arranged in a suitable way to be adjustable.

Figure 3B:
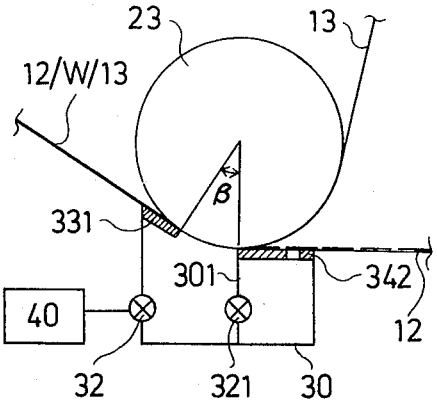
Figure 3A:
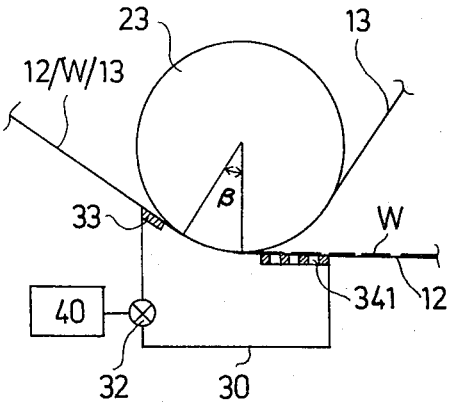

As shown in FIGS. 3A,4 and 5, the first cover part 33 in the direction of travel of the wires 12,13 is rather narrow. This cover part 33 is in most instances merely a sealing strip of the suction box 30 acting against the wire 12 and which may also operate as a kind of water doctor. The cross section of the strip may be selected with comparative freedom, and it may even be circular for instance. At the first cover part 33 the web has a comparatively high water content, whereby at this point there may still escape from the web a comparatively large quantity of water, which acts as an efficient lubricant and remarkably reduces the risk of wear of the wire 12 on this cover part 33.

The first cover part 33 may also be fairly broad, in which case it is advantageous to provide it, as planar suction box covers known in themselves in the art ane provided, with through holes or slits communicating with the interior of the suction box 30, whereby in the region of this cover part 33 there is exerted on the web W between the wires 12 and 13, substantially the effect of the vacuum prevailing in the detaching suction box 30.

It is of significance for the operation of the suction box 30 of the invention that it has the said free or open gap between the cover parts, in the area of which the change in direction of web travel takes place while as a result hereof a fairly powerful compression acts on the web W between the upper wire 13 and covering wire 12. As a result, a great amount of water can be expelled from the web W, this water being flung by centrifugal force effect into the suction box 30.

As regards the design of the second cover part 34 of the detaching suction box 30, several alternatives are available as compared with the first cover part, and these are in fact needed, since in the last run this second cover part determines how reliably the web W will be detached from the covering wire 13 and affixed to the carrying wire 12. Some of these alternatives are shown in FIGS. 3A,4 and 9.

The second cover strip 341, as shown in FIG. 3A, is in principle a conventional flat suction box cover known in itself in the art, which is perforated with through holes. The cover part shown in FIG. 4 comprises a perforated first, fairly wide strip 348, in addition to which the cover part comprises two narrow strips 349, by the aid of which in the cover part are established two suction slits 350 extending transversally across the entire wire breadth. The strips 348 and 349 may also be mounted in reverse order to that the suction slits precede the pierced-through strip 348 in the direction of web travel. The strip 348 may have a similar profile as the strip 33. The cover part illustrated in FIG. 9 has been separately described. It is clear that due to the task of the second cover part its total width must substantially exceed that of the first. The total width of the second cover part may be 2-3 times that of the first.

In the cover design of FIG. 3B, however, the free gap separating the cover parts 331 and 342 is equally large as the arc of the corresponding central angle $\beta$. It is advantageous in this case to use for cover parts of the suction box 30 such strip constructions 331,342 as have been depicted in FIGS. 7,8 and 9.

The body part of the suction box 30 of FIG. 3B has a partition 301 provided with an adjustable air flow aperture 321 and dividing the suction box 30 into two compartments, one of these corresponding to the first cover part 331 and to the sector $\beta$, while the other is delimited by the latter cover part 342. Since the vacuum system 40 is immediately connected to the compartment corresponding to the first cover part 331, in this compartment as a rule prevails a greater vacuum than in the compartment of the suction box corresponding to the latter cover part 342. Regarding the second cover part 342 it is essential that one be able to direct on the web sufficient suction so that the web W will after its detachment from the upper wire 13 follow reliably along with the lower wire 12. It should be noted that although the upper wire 13 has already become detached from the web W, there may at high speeds in the throat between the roll 23 and the lower wire 12 be created a suction effect which in certain cases tends to wrench the web W towards the upper wire 13 from the surface of the lower wire 12 unless there is a sufficient "supporting suction" at the second cover part 342.

The detaching suction box 30 may in certain instances have several compartments by the aid of which the suction is adjustable within the desired limits.

The providing of the detaching suction box 30 with a minimum of two parts also enables the suction to a be adjusted to desired level at various points of the suction box while the web W interposed between the wires 12,13 is passing over the cover part of the suction box 30. By the aid of such suction control, the desired dewatering effect is achieved, as well as the desired detachment of the web W from the upper covering wire 13, and its transfer to be carried onward by the lower carrying wire 12 alone. The suction control facility in this connection implies optimum use of vacuum energy, that is, avoidance of an unnecessarily high vacuum energy consumption. Whether stepwise control of suction is necessary in the first place, is however a question dependent on several factors, such as the paper machine speed, the type of pulp stock, etc.

Suction control in the region of the suction box 30 may take place similarly as in the case of conventional flat suction boxes by providing the suction box or each compartment thereof with its own connector communicating with the main vacuum line and fitted with a control valse 32. As mentioned hereinabove, the system may also be adapted so that one of the compartments of the suction box 30 is a so-called main suction compartment which communicates directly with the suction system of the paper machine, with the highest suction present therein. The suction in the rest of the compartments may then be controlled with the aid of a controllable throttling aperture 321 or equivalent placed in the partition separating the main compartment and the compartment in question.

FIGS. 4 and 5 display the geometry of the apparatus of the invention on the basis of a tried-out construction. In FIG. 5, the curved run of the wires 12 and 13 has been depicted as developed, i.e., as linear, and correspondingly the cover parts of the detachment suction box have been presented as lying in one plane. This enables the mutual magnitude proportions of the details belonging to the structure of the invention to be simply described.

The following correspondences are valid in FIGS. 4 and 5: $A \sim \alpha$; $D' \sim \Delta'$; $B \sim \beta$; $D'' \sim \Delta''$; $C \sim \gamma$. The free or open gap of the cover of the suction box 30 is $F = D' + D'' + B$.

At a speed of 1000 m/min, the dewatering of the apparatus was found to be quite efficient, replacing 3 to 5 of the suction boxes which are conventionally used between the forming roll 15 and the couch roll 24. The free gap F was about 300 mm, thereof the contribution of the directional change sector, 200 mm.

FIG. 7 displays in axonometric projection, a structural variant of the first cover part 331 of the suction box 30. The cover part 331 comprises one single strip, its plane face 332 which operates against the wire 12 being provided with special grooves 333, which parallel the run of the wire 12. The grooves 333 separated by lands 334 have a wedge-shaped longitudinal cross section so that they start, in the direction of travel of the wire, on the surface 332 of the cover part and increase in depth towards the rear margin of the strip so that a kind of "serration" is created on this rear margin. In FIG. 7, the reference symbols a,a',b,c and d indicate the dimensioning of the grooves. The principal dimensions of the cover strip, again, have been indicated with e and L.

It should be understood that in FIG. 7 only one possible groove arrangement has been merely schematically and in principle shown. The ratio a/b between the breadth a of the grooves 333 and the breadth b of the lands 334 thereinbetween may vary within fairly wide limits, depending on the operating conditions of the paper machine. The type of the wire fabric 12 used in the paper machine and which acts against the cover strip 331 in question, also has a great influence on the selection of the grooving. The ratio may be, for instance, $a/b = 1.5$ to 0.2, the lower value representing a case wherein e.g. $a = 2$ mm and $b = 10$ mm, while the upper limit value corresponds to a grooving with grooves 50% wider than the lands. It is not possible to state any exact value because the grooving is dependent, as mentioned already, on the quality of the wire fabric 12 used and in particular, on the stiffness of the fabric 12 in its transverse direction. The type of the grooving is also described by the ratio between the depth c of the grooves 333 and the breadth a of the groove at the rear margin of the strip 331, and which ratio may vary within the range $c/a = 5$ to 1, for instance.

As shown in FIG. 7 and as stated above, the grooves have been so machined or made that their walls are perpendicular to the plane of the strip. Likewise, it is shown in the figure that the grooves have uniform breadth, that is $a = a'$. One advantageous groove structure which partly solves the problems arising e.g. from insufficient stiffness of the wire fabric 12 is where the grooves 333 taper down significantly in the plane of the cover strip's surface towards the rear margin of the strip, for instance so that the ratio $a'/a = 5$ to 3. The resultant reduction of the grooves' 333 effective volume is made up for by slanting the walls of the grooves 333 so that the breadth of the groove 333 in the plane of the cover strip surface is considerably less than on the bottom of the groove. Such a structural detail variant has been shown in FIG. 8; the ratio of the dimensions indicated therein may be e.g. $a''/a = 5$ to 2 and $c/a'' = 1$ to 3.

The cover strips 33,34 of the suction box 30 may be completely smooth, that is without any grooving whatsoever. In such a case, there is at the starting point of the first cover part's rear margin and the directional change zone of the wires, preferably, a gap $\Delta'$ (FIG. 5) such that it renders possible a free air flow from the atmosphere into the suction box. The length of this gap $\Delta'$ is advantageously 30 to 70 mm, depending on the operating conditions of the machine. Satisfactory operation has been achieved with the said gap $\Delta'$ set at 50 mm.

The fact that the first cover strip 331 is grooved, e.g., as shown FIGS. 7 and 8, enables the rear margin of the strip 331 to be placed substantially at the same point where the directional change sector of the wires 12,13 commences. The grooving 333 in the strip 331 will then at least partially replace the said leakage air sector D' so that an air flow is achieved in the area in question through its sandwich structure 12/W/13 into the suction box 30, which is important for the operation of the suction box 30 both from the point of view of dewatering and with a view to the detachment of the web W from the upper wire 13 and its attachment to the lower wire 12 at this stage already.

As regards further the other dimensions L and e of the strip 331 presented in FIG. 7, L is exclusively dependent on the working width of the paper machine. The breadth of the strip e in the direction of travel of the wire 12 depends on several secondary structural factors, and the said breadth has no substantial effect on the operation of the suction box 30. It should be noted, however, that the breadth e must be substantially greater than the length d of the grooves, which is advantageously about 30 to 80 mm. The ratio d/e may be e.g. 0.6 to 0.8.

FIG. 9 presents, likewise in axonometric projection, a design of the latter cover part of the suction box 30 according to the invention, comprising a strip 342 provided with a planar top surface. The groovings 345 of the strip 342 start from the front margin of the strip 342, in the direction of travel of the wire. The various possible constructions of the grooving of this cover part are obvious from the descriptions referring to FIGS. 7 and 8. It is advantageous if the front side 347 of this strip 342 defines an acute angle with the surface 344 so that the strip 342 may in this part produce a kind of doctor effect. The cover strip 342 shown in FIG. 9 has been provided, on the side of the grooves 345 separated by lands 346, with holes 343, through which the cover part allows the subatmospheric pressure prevailing in the suction box 30 to act on the wire 12 lapping the cover part and on the fibre web W thereupon.

It has to be noted further as regards FIG. 9 that although the grooves 345 of the latter cover strip 342 have been presented with comparatively great width for the sake of clarity, the preferred construction in practice is one in which the grooves 345 are comparatively narrow so that the return of water removed from the web as it changes direction over the direction-changing sector of wires 12, 13 into the web W is prevented. With this in mind, a favorable groove geometry is one wherein $a \sim 2$ to 3 mm; $c/a \sim 5$ to 10 and $a'/a \sim 5$ to 10.

In the following is described, with reference to FIG. 6, an alternative design of the forming roll. As has been stated, the forming roll 15 may be a smooth surface roll or a grooved roll, or another kind of roll as well. As shown in FIG. 1, the forming roll 15 is one with a smooth surface, whereas according to FIG. 6 the forming roll 151 has been provided with a grooving 152 encircling its surface.

The forming roll 151 is lapped on a given sector by the lower wire 12, upon which the web W resides. Adjacent to the roll 151, the upper wire 13 is conducted upon the web W, and the sandwich structure thus achieved, 12/W/13, changes direction on the roll 151 and continues on its way to the detaching suction box 30. Between the roll 151 and the detachment suction box 30 there are preferably no members which would cause any substantial dewatering or any wire attrition.

As shown in FIG. 6, the forming roll is encircled by a chamber 153*a* except for the sector $\beta_F$, in the region of which the wire 12 is substantially adjacent to and in contact with the forming roll. In the area of this sector, the upper wire 13 is conducted to cover the web W. In the region of this sector a gradually increasing pressure acts on the web W, caused by the wire 13, and owing thereto water tends to escape from the web through both wires 12 and 13. The chamber 153*a* has been connected to an overpressure source 41 through a valve connector 154. The overpressure (+) is admitted to act through the grooves 151 at the sector $\beta_F$ on the web upon the lower wire 12 so that the dewatering through the wire 12 can be at least partially inhibited if this is necessary. At all events it is possible with the aid of the pressure in the chamber 153*a* to control the dewatering in the region of this roll 151. The chamber 153*a* has been provided with a cover part 157 operating against the wire 12, and which may be formed with through holes.

In certain special cases a subatmospheric pressure may be arranged in the chamber 153*a* as well.

In immediate conjunction with the chamber 153*a* and before it, as viewed in the direction of travel of the wire, has been disposed another chamber 153*b*, connected through a connector 155 to a vacuum surce 40. The chamber 153*b* has been provided with a cover part 156 which partly extends to cover the chamber 153*a*. The cover part 156 forms a small angle with the wire 12 and it is, partially at least, provided with through holes in its portion overlying the chamber 153*b*.

With the aid of the chambers 153*a* and 153*b*, the direction and amount of dewatering in the region of the roll 151 are easily controllable.

Considering generally the operation of the detachment suction box 30 and of the guide roll 23 of the upper wire 13 operating in its connection, the following factors may be observed to have their significance. The rotation of the wire guide roll 23 induces an "air cushion" which develops in the throat defined by the wire guide roll 23 and the wires 12,13 and gives rise to a pressure urging the web W interposed between the wires against the lower wire 12. Acting in the same direction is the vacuum prevailing in the suction box 30 and in its different compartments, if any. Furthermore, the centrifugal force in connection with the directional change of the travel of wires 12,13 naturally has an effect tending to detach the web W from the upper wire 13.

All those factors notwithstanding which promote the detachment of the web W from the upper wire 13, the detachment of the web W is not fully ascertained without the latter cover part of the detachment suction box 30, by the aid of which a "safeguarding suction" is made to act on the web W. Among those factors which render such "safety" suction necessary is, for instance, the excessively strong adhesion, resulting from one reason or another, of the upper wire 13 to the web W, and the suction effect produced at the point of separation of the upper and lower wires 12,13. It depends on the paper grade or fibre web quality and on the machine speed how high and how prolonged a suction must be directed against the web W through the lower wire 12 in order to reach the desired result. The duration of suction is obviously proportional to the breadth, in the direction of travel of the wires, of the latter cover part of the suction box 30.

The combination apparatus formed together by the detachment suction box 30 and the wire guide roll 23 guiding the run of the wires 12 and 13 renders possible a dewatering process in the region of the suction box which is adjustable and controllable within wide limits. The task of this apparatus is dual, and it has reference both to the dewatering of the web W and to the detaching of the wire W from the upper wire 13 and its attachment to the lower wire 12, that is to the carrying wire. Which one of the two tasks has to be given main weight depend on several factors, e.g. on the type of pulp stock being handled and its dewatering properties; on whether plain or multi-ply web is being made; and on the properties of adherence of the web material to the upper wire. Process parameters affecting the operation of the apparatus in question, particularly from the viewpoint of dewatering action, are the tension of the lower wire 12 against the upper wire 13 and the roll 23, the magnitude of the directional change angle of the lower wire 12, the length of the free gap F of the suction box 30, the vacuum prevailing in the suction box 30, the length B of the arc corresponding to the directional change angle, which with a fixed directional change angle is proportional to the diameter of the guide roll 23, the centrifugal force acting on the sector $\beta$, which is inversely proportional to the diameter of the guide roll 23, and the total time which the web W spends in the region A+F+C of the suction box 30.

Process variables which in their turn exert an influence on the detaching of the web W from the upper wire 13 and its transfer to the lower wire 12 are the material, "mesh", fabric structure etc. of the wires used, the design of the second cover part 34 of the suction box 30 after the directional change sector $\beta$, the time which the web W is subject to the effect of suction in the leakage air zone D" immediately following the directional change sector, on the second cover part 34 of the suction box, and the magnitude of vacuum prevailing in the suction box 30, expressly in the region of the second cover part 34.

In the miniature paper machine of the applicant's pilot plant, the inclination of the lower wire 12 arriving at the suction box 30 with reference to the horizontal plane is about 37 degrees. Since the inclination of the wire 12 as it leaves the suction box 30 is 8 degrees downward, the directional change of the lower wire 12 is thus 29 degrees, which is the extent of the sector on which the upper and lower wire 12,13 travel together, separated by the web W, at the guide roll 23 (with a diameter of 800 mm). The location, shown in FIGS. 1 and 4, of the rolls 15,23 and 24 and of the suction box 30 is roughly consistent with conditions as they were in the trial paper machine.

The guide roll 23 is preferably one with a smooth surface, and it is then most advantageous to use the above-described leakage air zones D' and D" on the either side of the directional sector $\beta$ of the web W and the wire 12. In some special cases, the invention may also be implemented so that there are no actual leakage air zones of the kind mentioned at all. In that case an effect corresponding to the operation of the leakage air zones, if employed at all, can be obtained by arranging the shell of the guide roll 23 to be grooved so that the air is able to move via this grooving through the sandwich structure 12/W/13. This design may however present the drawback that the said grooves may owing to effect of the compression between the wires 12 and 13 accumulate water, which is splashed back into the web after the directional change sector $\beta$ and as the web W separates from the wire 13. The said grooving of the guide roll 23 is preferably one running around the roll shell and achieved e.g. by fitting the roll 23 with a covering made of profiled strip material by winding.

Although in the foregoing the talk has been of wires 12,13, this wording is also meant to refer to various fabrics used in wire sections, e.g. to felts of a special design.

In the foregoing, the detachment suction box 30 of the invention and the procedure in the wire section of a paper machine described in connection therewith have been described as being applied in connection with a certain type of wire section. It should be noted, however that the detachment suction box of the invention is well applicable in many different kinds of wire section, which differ even altogether substantially e.g. from the wire section total design presented in FIG. 1.

In the following are stated the claims within the scope of the inventive idea defined by which various details of the invention may vary.

I claim:

1. In a former of a paper making machine including a carrying wire loop having a run on which a web is carried and in an initial part of which the web is substantially dewatered in one direction through said initial carrying wire part, and a covering wire loop conducted onto the web carried on said carrying wire at a point following said initial part to cover the web to form a joint run of a sandwich structure constituted by said web carrying wire, said web covering wire and the web carried therebetween and wherein the web is dewatered on said joint run through said covering wire, said joint run ending at a point where the covering wire separates from the carrying wire and web carried thereby and whereupon the web is carried on the carrying wire for conduction to a press section of the paper making machine, the improvement comprising:

a wire guide roll situated within said covering wire loop at the end of said joint run in the region in which said covering wire separates from the web to guide said covering wire away from said carrying wire, said joint run engaging a sector of said guide roll over which sector the direction of said joint run changes; and a suction box situated within said carrying wire loop in cooperating relationship with said wire guide roll, said suction box comprising first and second cover parts arranged in the machine direction defining a substantially free gap therebetween, said free gap facing the portion of said joint run which engages said direction-changing sector of said guide roll, said two cover parts having respective surfaces forming an angle with respect to each other, said web carrying wire engaging each of said cover part surfaces to thereby change its direction over an angle corresponding to the angle formed by said cover part surfaces, and wherein said covering wire separates from said joint run prior to said second cover part of said suction box and follows said guide roll away from said carrying wire while the web carrying wire contacts said surface of said second cover part, whereby the web is further dewatered in the region of said directional change of said joint run partly by the pressure of said wires against said web and the centrifugal force created by said change in direction, and partly by the differential pressure created by said suction box.

2. The combination of claim 1 wherein the dimension of said suction box tranverse to the machine direction is less than the corresponding dimension of said carrying wire and wherein said suction box includes end sealing means at its tranverse ends for supporting marginal regions of said carrying wire.

3. The combination of claim 1 wherein said guide roll is provided with a grooved surface.

4. The combination of claim 1 wherein said suction box includes partition means for dividing the same into at least two compartments, and wherein the subatmospheric pressure in a respective compartment is different from that in another compartment.

5. The combination of claim 1 wherein the length of the peripheral surface of said guide roll corresponding to said sector over which the direction of said joint run changes in less than the length of said free gap between said suction box cover parts, and wherein thereby are formed a first leakage air zone between a downstream edge of said first cover part and said guide roll and a second leakage air zone between an upstream edge of said second cover part and said guide roll, air passing through said joint run in the region of said leakage air zones under the suction effect prevailing in said suction box.

6. The combination of claim 1 wherein at least one of said cover parts of said suction box has openings formed therethrough.

7. The combination of claim 1 wherein said surface of at least one of said cover parts is formed with groove means over which said joint run travels for admitting air through said joint run under the effect of the suction prevailing in said suction box even in the case where the length of said free gap defined between said suction box cover parts substantially equals the length of the peripheral surface of said guide roll corresponding to said sector over which the direction of said joint run changes.

8. The combination of claim 1 wherein said second cover part of said suction box has a substantially greater breadth in the direction of movement of the carrying wire than that of said first cover part.

9. In a method in a former of a paper making machine for dewatering a web at least partially between two wires and for detaching the web from one of the wires, the former including a carrying wire loop and a covering wire loop wherein an initial dewatering of the web takes place on an initial part of the run of the carrying wire loop, and wherein the covering wire loop is conducted onto the web carried on the carrying wire at a point following said initial part to cover the web to form a joint run of a sandwich structure constituted by the web carrying wire, the web covering wire and the web carried therebetween, and wherein the web is dewatered on the joint run through the covering wire, the joint run ending at a point where the covering wire separates from the carrying wire and web carried thereby whereupon the web is carried on the carrying wire for conduction to a press section of the paper making machine, the improvement comprising the steps of:

situating a guide roll within the covering wire loop at the end of the joint run so that the joint run engages a sector of the guide roll;

situating a suction box within the carrying wire loop in cooperating relationship with the wire guide roll, the suction box including first and second cover parts defining a substantially free gap therebetween, the free gap facing the portion of the joint run which engages the sector of the guide roll, the two cover parts having respective surfaces forming an angle with respect to each other;

conducting the joint run so that the carrying wire engages the surface of the first cover part of the suction box;

changing the direction of the joint run by conducting the same over the sector of the guide roll with the guide roll pressing against the joint run from the side of the covering wire;

dewatering the web substantially in the area of the directional change under the effects of the pressure of the wires on the web, the centrifugal force acting on the web produced by the change in direction thereof as the joint run is conducted over the guide roll sector, and by the pressure differential created by the suction box;

separating the covering wire from the carrying wire and web carried thereby and causing the covering wire to follow the guide roll while simultaneously subjecting the web and carrying wire to suction effect created by the suction box; and conducting the web carrying wire subsequent to said separation step into engagement with the surface of the second cover part of the suction box.

10. The combination of claim 9 wherein a leakage air zone is provided in at least one of the regions prior and subsequent to the change in direction of said joint run and passing air through the joint run into the suction box in the at least one leakage air zone.

11. The method of claim 9 wherein the joint run is subjected to at least two magnitudes of differential pressure.

12. The method of claim 11 wherein the magnitude of the differential pressure increases in the direction of travel of the joint run.

13. The method of claim 9 wherein the web carrying wire engaging each of the cover part surfaces changes its direction over an angle corresponding to the angle formed by the cover part surfaces.

14. The method of claim 9 wherein the length of the peripheral surface of the guide roll corresponding to the sector over which the direction of the joint run changes is less than the length of the free gap between the suction box cover parts.

* * * * *